United States Patent [19]

Uhlíř

[11] 4,005,589

[45] Feb. 1, 1977

[54] KNITTING ELEMENTS

[75] Inventor: Pavel Uhlíř, Trebic, Czechoslovakia

[73] Assignee: Elitex, Zavody textilniho strojirenstvi generalni reditelstvi, Liberec, Czechoslovakia

[22] Filed: Nov. 27, 1974

[21] Appl. No.: 527,649

[30] Foreign Application Priority Data

Nov. 28, 1973 Czechoslovakia ..... 8181/73

[52] U.S. Cl. ..... 66/95

[51] Int. Cl.[2] ..... D04B 35/02; D04B 9/06

[58] Field of Search ..... 66/95, 24, 123, 173

[56] References Cited

UNITED STATES PATENTS

| | | | |
|---|---|---|---|
| 885,150 | 4/1908 | Foster | 66/95 |
| 2,164,337 | 7/1939 | McAdams | 66/95 |
| 2,181,679 | 11/1939 | McAdams | 66/95 |
| 2,250,658 | 7/1941 | Smith et al. | 66/24 |
| 2,667,770 | 2/1954 | Sirmay | 66/95 |
| 2,740,276 | 4/1956 | Minton | 66/95 |
| 2,761,302 | 9/1956 | Nebel | 66/95 |
| 2,809,508 | 10/1957 | McDonough | 66/95 |
| 3,783,644 | 1/1974 | Mutze et al. | 66/95 |

FOREIGN PATENTS OR APPLICATIONS

| | | | |
|---|---|---|---|
| 625,453 | 11/1962 | Belgium | 66/95 |

*Primary Examiner*—Mervin Stein
*Assistant Examiner*—A. M. Falik

[57] ABSTRACT

Knitting elements for a single cylinder knitting machine adapted to be reciprocatingly mounted in the grooves of the dial knit loops and to transfer the loops to the needles. The knitting elements comprise a pair of blade-like members movable with respect to each other. One of the members has an operative end forming an upwardly directed finger having a forward tip and a front and rear yarn receiving beds on its upper edge, the second of the members has an operative end forming a downwardly directed finger having a forward tip above the level of the surface of the front bed of said one member, an upper edge rising from the tip thereof to the level above the rear bed of the one member and a lower edge forming with the front bed of said one member a space therebetween for gripping a yarn loop.

7 Claims, 17 Drawing Figures

KNITTING ELEMENTS

BACKGROUND OF THE INVENTION

The present invention relates to the formation of knitting elements mountable in the dial of a single cylinder knitting machine having operative ends for forming knit loops and for transferring the same to the cylinder needles.

In general, the formation of a knitted hose or the like on a single cylinder knitting machine is accomplished by making the loops entirely on the needles located in the vertical tricks of the cylinder. As a consequence, the structure of the knit pattern is formed only with plain loops. For that reason, the goods produced on such machinery have the disadvantage, characteristic of plain knit work, resulting in a small degree of extensibility or elasticity as well as a tendency for its borders or welts to twist. These disadvantages are somewhat reduced in two or double cylinder knitting machines in which the needles, when in the lower cylinder, are used for plain loops, but when transferred to the upper cylinder are used to form purl loops.

On the other hand, two cylinder knitting machines have the disadvantage that they require constant supervision and close attention by the operator. They are more subject to failure and have a lower efficiency. Consequently, in order to combine the advantages of a two cylinder knitting machine with those of a single cylinder knitting machine, certain one cylinder knitting machines have been provided with auxiliary latch needles or similar needles which are mounted in the transfer dial. These auxiliary needles are actuated to move radially in cooperation with the vertically moving cylinder needles, to produce a knit work made of both plain and purl loops. Nevertheless, this system still has the disadvantage that there is inherent an unreliable transfer of the loops from the dial needles to the cylinder needles. Furthermore, there exists the frequent breakdown of the latch needles, in the dial making it necessary to effect a precise adjustment to the cylinder and dial so that their needles are properly aligned during transfer.

It is the object of the present invention to provide a single cylinder knitting machine with means for simply and efficiently producing both plain and purl loops, without the use of auxiliary latch needles in the dial.

It is another object of the present invention to provide a single cylinder knitting machine with simple transfer elements capable of forming both knit loops as well as being capable of transferring the loops to the needles.

It is a further object of the present invention to provide an improved single cylinder knitting machine overcoming the aforementioned disadvantages.

The foregoing objects, other objects as well as numerous advantages will be apparent from the following disclosure.

SUMMARY OF THE INVENTION

According to the present invention at least two displaceable knitting elements, cooperating with each other, are mounted within each groove of the dial of a single cylinder knitting machine. The knitting elements are provided with operative ends for forming knit loops and for transferring such loops to the cylinder needles. The knitting machine elements have control butts, engaging suitable dial cams which reciprocate the elements in cooperation with the cylinder needles and with the sinkers of the single cylinder knitting machine.

The cooperating knitting elements comprise one employed to receive and grip the yarn and a second to effect the casting and transfer of the loop. The first element is provided with an operative end formed in an upwardly curved finger which defines a forward tip and a pair of yarn receiving beds arranged one behind the other. The second element is formed having an operative end provided with a downwardly curved finger, defining a forward tip arranged above the level of the front bed and a rising upper edge extending above the level of the rear bed. The curved fingers when arranged so that their tips are abreast of each other form a space between them in which the yarn may be gripped and held.

With the cooperating knitting elements described above, the yarn may be laid on one bed, carried through the previously formed loop, laid on the other bed to form an interlocking loop and thereafter cast onto the needle. To facilitate the movement of the cylinder needle, during this process, one of the elements is bent to provide a shoulder through which the needle may pass.

To strengthen the construction and assembly of cooperating knitting elements, a single element of the second type may be arranged between a pair of elements of the first type. The elements of the first type being mirror images of each other and being moved simultaneously, while the element of the second type would be moveable independently of the two.

Full details of the present invention are given in the following description of its embodiments and are shown in the accompanying drawings, illustrative of the same.

DESCRIPTION OF THE INVENTION

Figure 1:
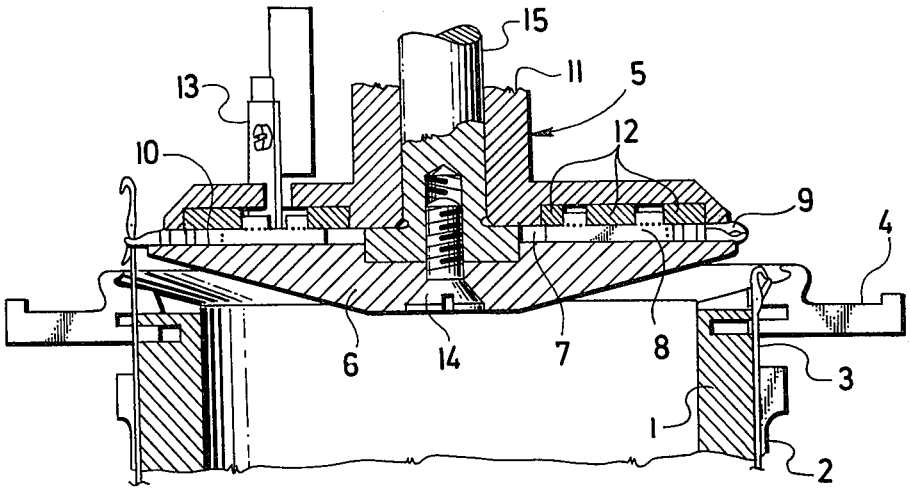
FIG. 1 is an axial section through the center of a single cylinder knitting machine showing the upper portion of the needle cylinder and the rib dial together with the knitting elements and the cams for controlling the reciprocation of these elements.

FIG. 1 is an illustrative example of that section of a conventional single cylinder knitting machine to which the present invention is applied. Except for the apparatus described herein, the machine does not require further illustration or description for those skilled in the art to understand the present invention, the same being well known to them.

The machine comprises a needle cylinder 1, having a plurality of parallel longitudinal grooves 2, in the exterior surface, in which needles 3 are moveably mounted. Located about the periphery of the upper end of the needle cylinder are a plurality of knock-over sinkers 4 mounted and controlled, in conventional manner so as to reciprocate in a horizontal direction cooperating with the needles.

Mounted coaxially at the upper end of the needle cylinder is a rotatable rib dial, generally depicted by the numeral 5. The dial comprises a lower supporting disk 6 having a plurality of radially extending grooves 7 in each of which is moveably mounted the cooperating knitting elements of the present invention.

The knitting elements as seen in the illustrative embodiment of FIGS. 5 – 10 comprise a set of three blade-like members 8, 9 and 10, arranged side by side in sliding contact with each other. The blades have a smooth lower edge resting on the bottom surface of the groove 7. The knitting elements are seen in detail in FIGS. 2 – 4, the outer members 8 and 10 being mirror images of each other are described and shown only in FIG. 2. These outer members 8 and 10 are provided with an operative forward end for receiving and holding the yarn and the loops which are made, while the inner blade 9 is provided with a differing form of an operative forward end which is adapted to transfer the loops. Each of the elements 8, 9 and 10 have control butts formed on their upper edges, to the rear of the operative ends and the rib dial is provided with a stationary lid 11, on its under surface on which are mounted a plurality of stationary cams 12 and through which are mounted a plurality of moveable cams 13, of which only one is shown. The cams engage the butts of respective members 8, 9 and 10 and control their radial reciprocation in their respective grooves, synchronously with each other. The lower disk 6 is fixed by a screw 14 to a central shaft 15 which is, in turn, connected by suitable gearing to the drive means for the needle cylinder itself. In this manner, the dial disk 6 and the needle cylinder 1 are synchronously rotated with each other.

Figure 2:
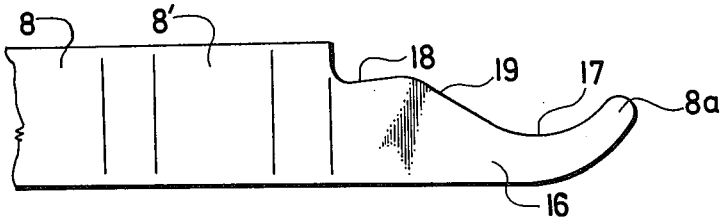
FIG. 2 is a side view of the forward or operative end of the gripping element.
Figure 5:
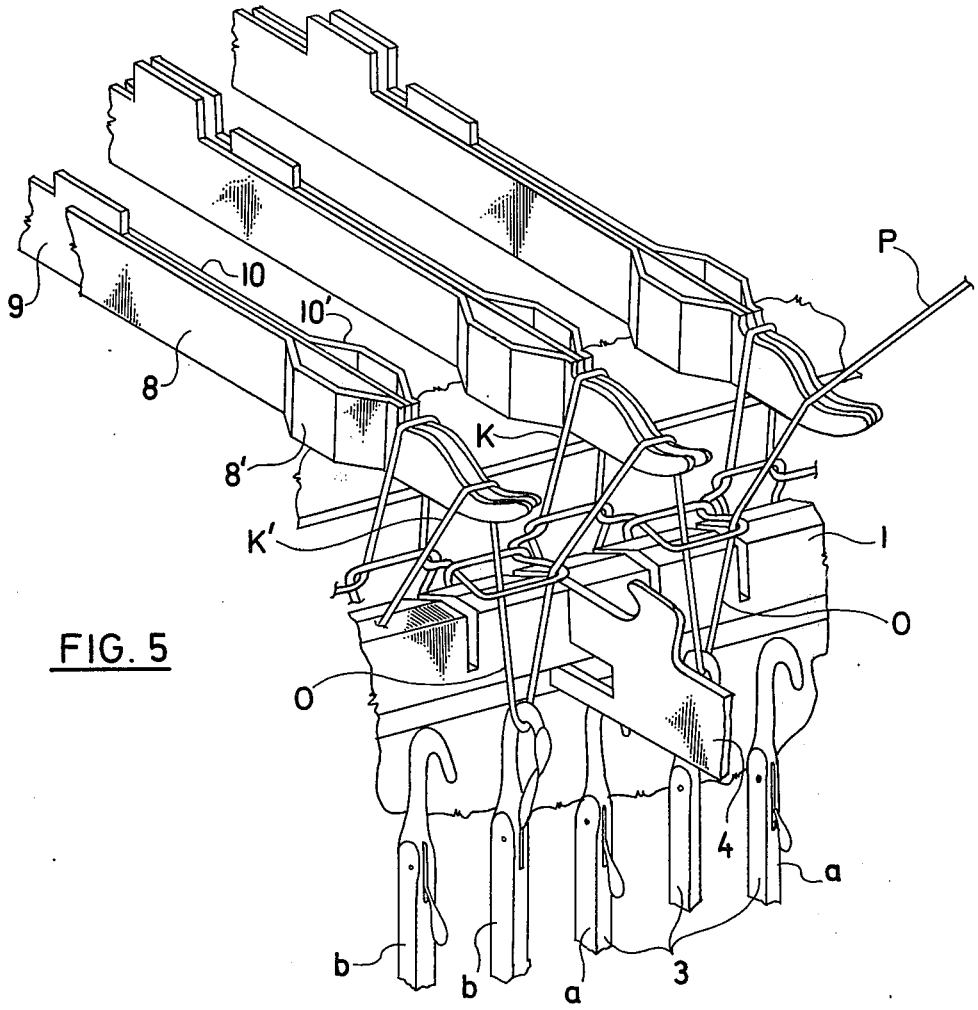
FIGS. 5 – 8 are each perspective views of a portion of the knitting machine showing the transfer elements in the dial and the needles in the needles cylinder, schematically, in the several steps for forming the knit loops.
Figure 10:
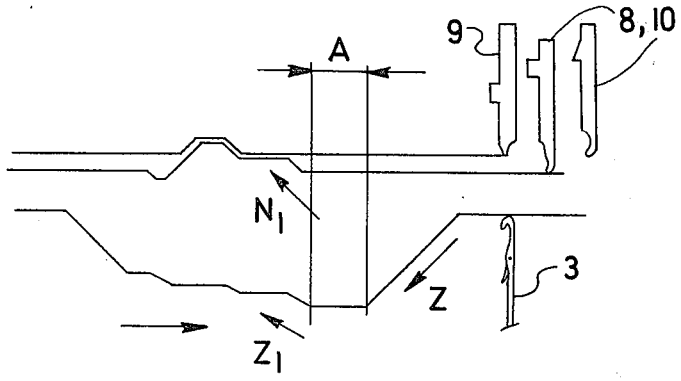
FIGS. 10 – 13, respectively, are the course diagrams of the knitting elements and the needles corresponding to the procedures shown in FIGS. 5 – 8, respectively.

As seen in FIG. 2 the first of the knitting elements, the yarn gripping member 8, is provided with an operative end 16 which is in the shape of an upwardly directed finger, the lower edge curving upwardly to form a forward tip 8*a*. Rearwardly from the forward tip 8*a*, the upper edge of the member 8 is provided with a pair of cupped curved beds 17 and 18 which are arranged one behind the other. The rear bed 18 lies above the front bed 17 and is interconnected with it by a rising slope 19. Further, the member 8 is bent, behind the rear bed 18, to form a lateral shoulder 8′ which is directed outwardly from the plane of the member, in a direction away from the central transfer member 9 as seen in FIG. 5. This shoulder 8′ permits the vertical upward movement of the needle, as seen more clearly in FIG. 9. The second of the pair of gripping members 8 and 10, namely member 10, is seen clearly in FIG. 5. This member 10 is identical to that of member 8, including its identity in length, height, and placement of its control butt, except that it is bent to form a shoulder 10′ which is oppositely directed to that of the shoulder 8′.

Figure 3:
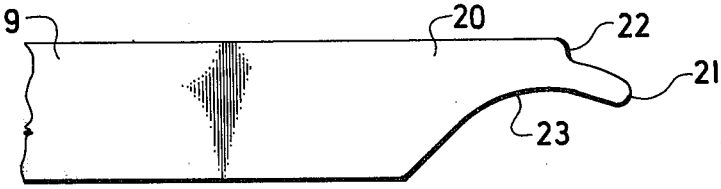
FIG. 3 is a view similar to that of FIG. 2 showing the operative end of the transfer element.
Figure 4:
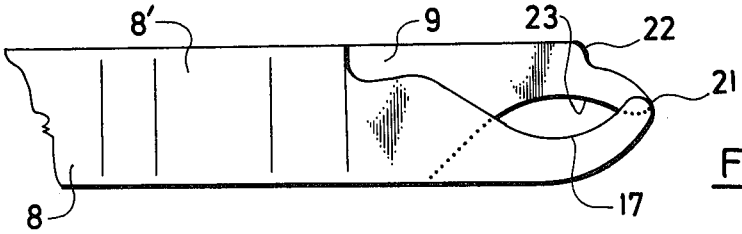
FIG. 4 is a view similar to that of FIGS. 2 and 3 in which the elements are shown in their cooperating relationship and wherein the operative ends are abreast of each other.

The second of the knitting elements, namely the transfer member 9, is seen in detail in FIG. 3. This element is also an elongated flat blade-like member having an operative forward end 20. The forward end 20, however, is shaped like a downwardly directed finger having a forward tip 21 from which the upper edge rises in an arc partially to the rear of the operative end, terminating in a vertical edge portion 22 which connects the arc to the upper linear edge of the member 9. The lower edge 23 of the operative end of the member 9 is curved in an arch upwardly to form a recess which, as seen in FIG. 4, defines a space between it and the bed 17, when the two members 8 and 9 are abreast of each other, so that a yarn may be gripped therebetween. The tips 8*a* and 21 overlap each other when the elements are abreast, so that the space between the surfaces 23 and 17 is enclosed.

In FIG. 4, the members 8, 9 and 10 forming the knitting elements, of the present invention, are shown arranged with their tips abreast of each other, and their upper and lower edges aligned. It will be observed that the tip 21 of the transfer member 9 is formed so that it lies above the level of the surface of the front bed 17. Further, the rising curved upper edge of the transfer member 9, between its tip 21 and its vertical edge 22, lies below the level of the surface edge of the rear bed 18, while the vertical edge 22 rises above it.

Figure 6:
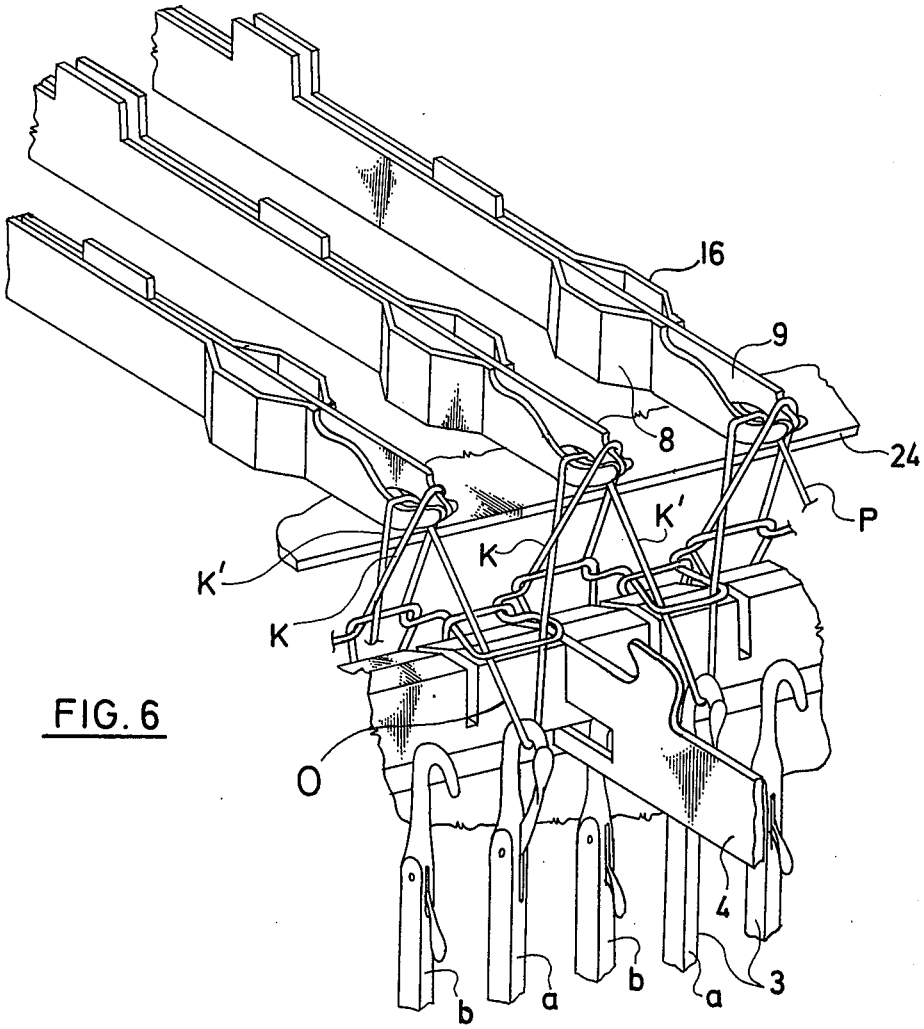
Figure 7:
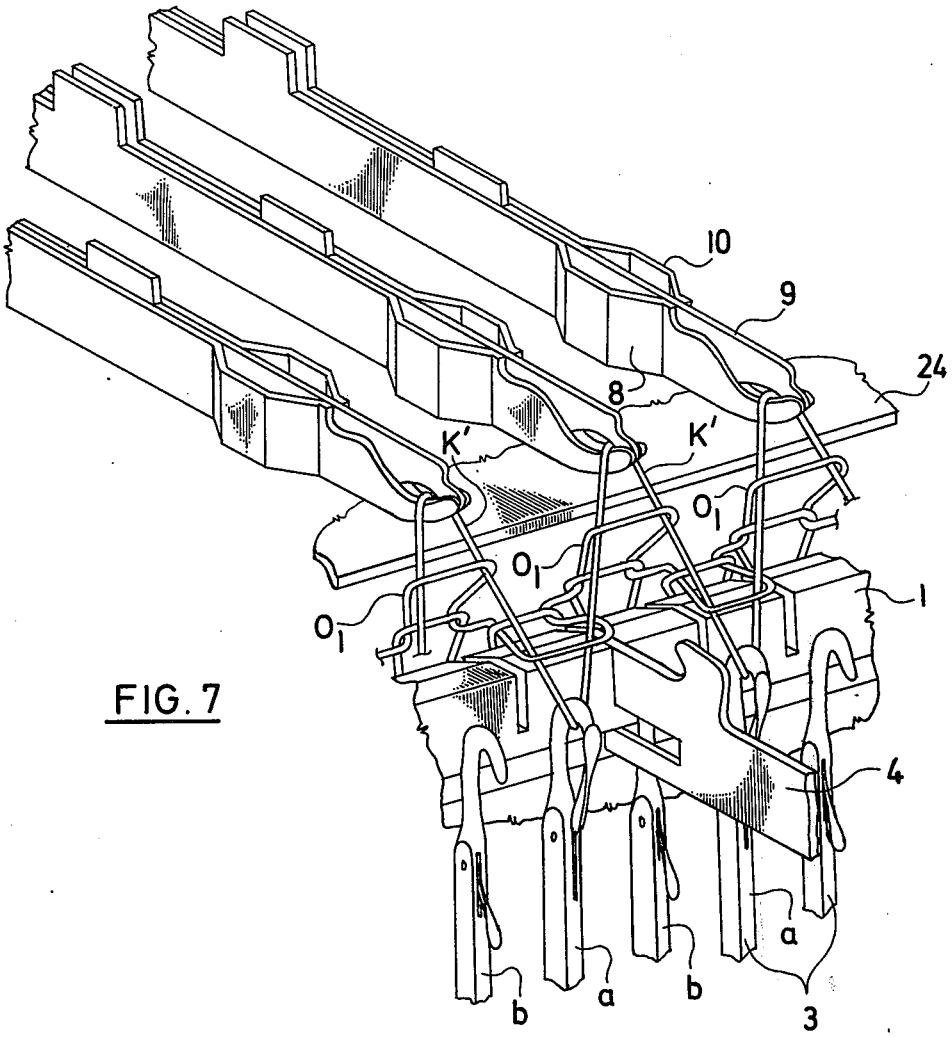
Figure 8:
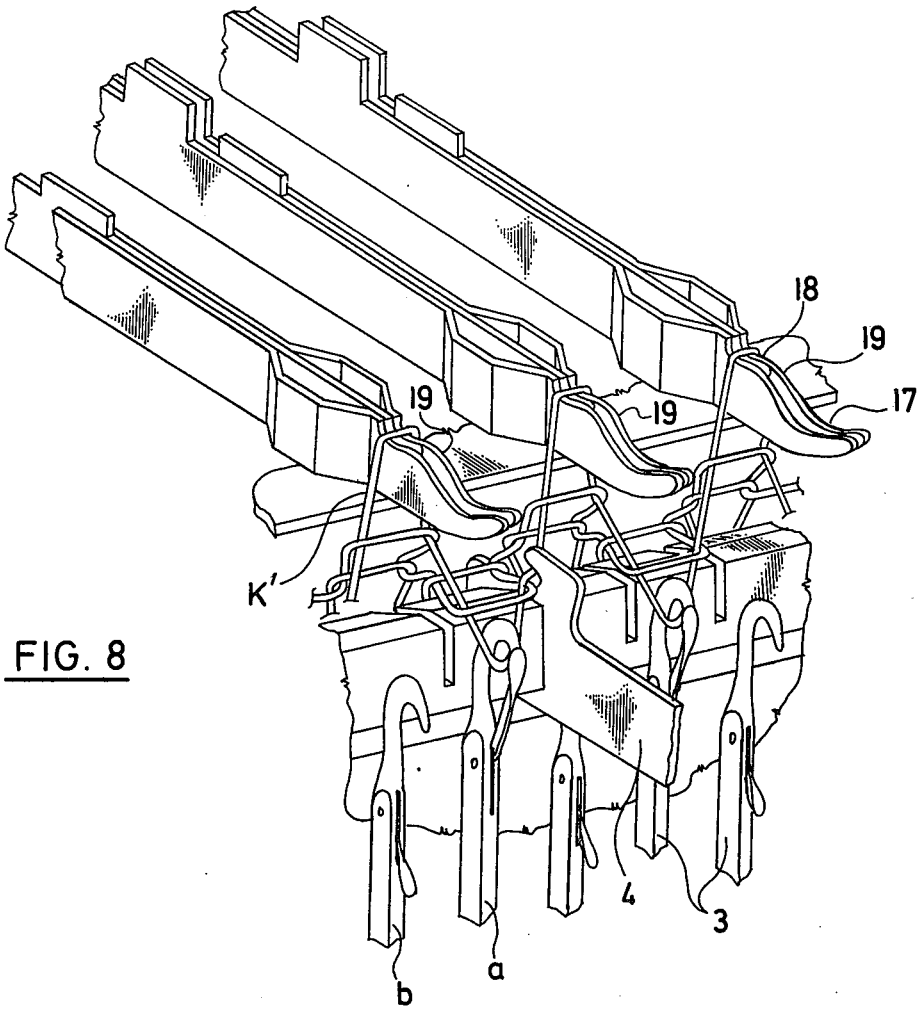

In operating the knitting elements of the present invention, a welt or border area may be formed having both knit and purl loops. When the final course of the regular hose body is completed, the needles 3 are distributed conventionally in a 1:1 manner. That is, alternate needles 3*b* are held inoperative in the needle cylinder and the loops previously formed by them are transferred to the dial knitting elements, while the other needles 3*a* are moved operatively to form the border loops. This situation is illustrated in FIG. 5 and its associated schematic diagram, FIG. 10, which illustrates the entire cycle of movement of the knitting elements, needles, etc. for one complete course; the needle cylinder rotating to the right as seen in the drawings. FIG. 5 illustrates the position of that portion of the knitting machine between the arrows A of FIG. 10 at the start of the operating cycle, while FIGS. 6 – 8 show subsequent stages of operation.

In the initial stage illustrated in FIG. 5, the pair of gripping members 8 and 10 are simultaneously projected forward from the rib dial to extend over the edge of the needle cylinder so that the previously formed yarn loop K can be placed on to the rear bed 18 in front of the vertical wall 22 of the transfer element 9. The transfer element 9 is retracted in the rib dial, rearwardly, relative to the gripping members 8 and 10, so as not to interfere with this placement. A yarn P is then laid onto the front beds 17 of the projecting gripping members 8 and 10 by means of a conventional, not illustrated, yarn guide. At the initiation of the cycle illustrated in FIG. 5, the operative needles 3*a* grip the yarn P and pull it downwardly, in the direction Z (FIG. 10) forming rib loops O in cooperation with the knock-over sinkers 4 and new loops K 'by drawing the yarn on the front beds 17 of the operative ends 16 of the gripping elements 8 and 10.

Figure 11:
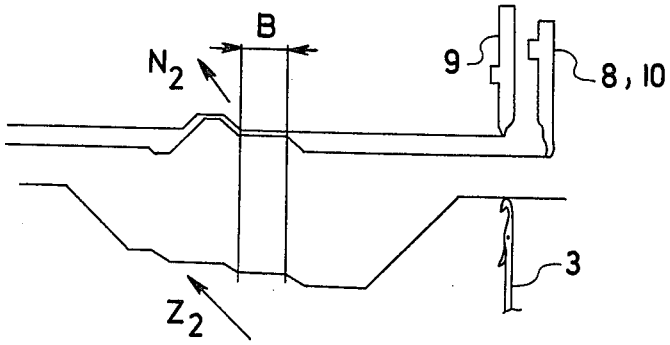

To complete the formation of the loops K', from the yarn P, the gripping members 8 and 10 are retracted in the direction N (FIG. 10) displacing these elements simultaneously toward the center of the rib dial 5. The members 8 and 10 thereby move rearwardly with respect to the transfer member 9. As a result, each loop K, located on the rear bed 18, is engaged by the vertical edge 22 of the transfer member 9 (FIG. 6). Simultaneously, the new loop K' held on the front bed 17 is drawn, by the rearward movement of members 8 and 10, through the loop K. In order to reduce the tension in the loops K and K' all of the needles 3 are projected vertically upward, simultaneously with the movement of the members 8 and 10, as seen by the directional arrow $Z_1$ (FIG. 10) At the termination of this step, the elements are in the position shown in FIG. 6, corresponding to the distance B illustrated in FIG. 11.

Figure 12:
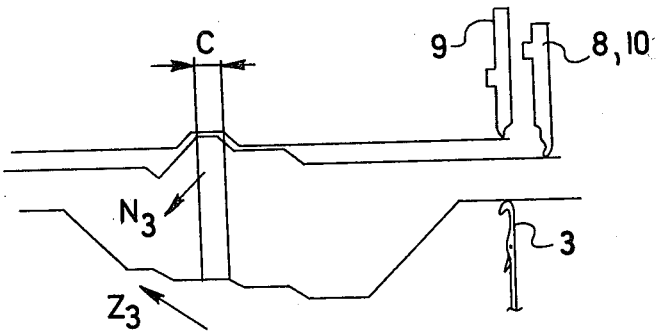

The loops K and K' are thereafter drawn by simultaneously retracting elements 8, 9 and 10 in the direction $N_2$ (FIG. 11) and by projecting the needles 3 upwardly in the direction $Z_2$, again for the purpose of releasing the tension in the yarn. The loops K', held securely in the space between the transfer member 9 and the gripper members 8 and 10, are pressed against the edge 24 of the dial disk 6 (FIG. 6) and because loops K on the upper edge of the operative end 20 of the transfer elements 9 are not closed, they (loops K) slide down and are gripped over the yarn forming the loops K'. This forms purl loops $O_1$ as shown in FIG. 7. The position of the needles 3 and the elements 9 and 10, corresponding to FIG. 7 is indicated in FIG. 12 by the distance C.

Figure 13:
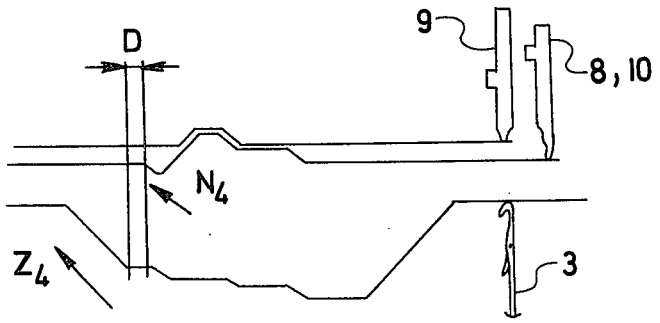

After forming the purl loops $O_1$, the elements 8 and 10 are projected radially outwardly in the direction $N_3$ (FIG. 12) while the motion of the transfer member 9 is interrupted remaining stationary relative to the gripping members 8 and 10. Thus, the loops K' are carried in the lower bed 17 by the moving gripping element members 8 and 10 forwardly below the bottom surface of the tip 21 of the stationary transfer member 9 which appears to move to rear relative to the gripping members 8 and 10. Once the transfer member 9 reaches the relative position seen in FIG. 8, where the vertical edge 22 is behind the upper bed 18, then further forward movement of the gripper members 8 and 10 causes the loop K' to ride onto the bed 18 and over the tip 21. As a result, the loops K' are transferred from the front bed 17 along the inclined edge 19 onto the rear bed 18, as is shown in FIG. 8. During this process the active or operative needles 3*a* are moved upwardly in the direction $Z_3$ (FIG. 12) further releasing the tension on the loops K'. When the loops K' are transferred to the bed 18, the gripping members 8 and 10 are reciprocated radially toward the center of the dial, in the direction $N_4$ (FIG. 13), thus, causing these members to assume the position as shown in FIG. 8. The position of the needles and the transfer elements corresponding to that of FIG. 8 is indicated in FIG. 13 by the distance D. The active or operative needles 3*a* are then continued in their upward movement, the in the direction $Z_4$ permitting the loops to relax so that the sinkers 4 can act to draw the loops as indicated in FIG. 8. Thereafter, the needles return to the initial position indicated in FIG. 5 and the gripping members 8 and 10 are prepared to receive a further yarn.

Figure 9:
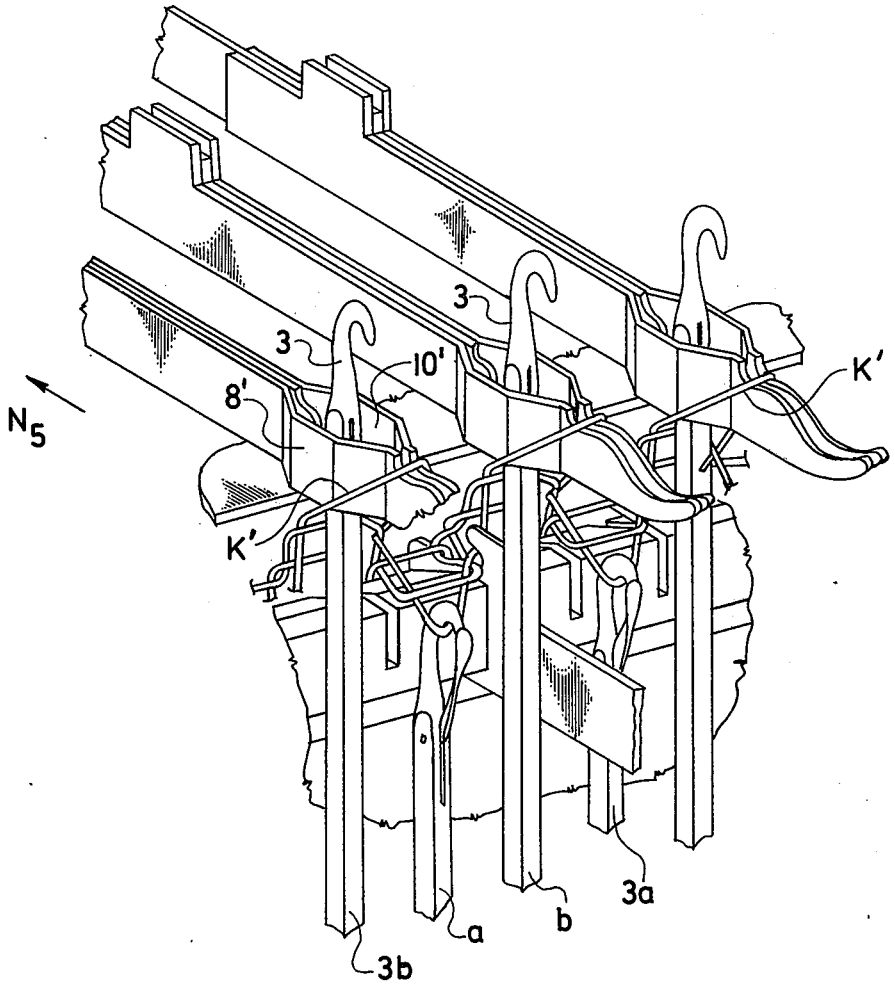
FIG. 9 is a view similar to those in the FIGS. 5 – 8 showing the position of the cylinder needles and the knitting elements upon the transfer of the loops to the cylinder needles.

This procedure is continuously repeated until the necessary number of wales are provided which comprise knit loops. At the moment that knitting passes from formation of purl loops to the formation of rib loops, the gripping elements 8 and 10 are projected as indicated in FIG. 9, i.e., radially outward beyond the surface of the knitting needle cylinder so that the bent portions 8' and 10' lie above the needle 3. The heretofore inactive needles 3*b* are then raised into the space formed by the shoulders 8' and 10' whereupon the knocking over of the loops from the rear bed 18 and their transfer to the cylinder needles 3*b* can be accomplished. This is performed by thereafter retracting the gripping members 8 and 10 in the direction $N_5$ (FIG. 9) in the known manner so that the loops K' engage beneath the hooks of the needles 3*b*.

In the formation of the body of knit work on a single cylinder, the sinkers 4 cooperate only with the cylinder needles 3. However, during the formation of loops on dial elements, the sinkers 4 are shifted away from the needle cylinder, as seen in FIGS. 5, 6 and 7. They are displaced toward the needle cylinder only at point D. Also, the sinkers need not operate during formation of either purl loops and rib loops in double-cylinder machine, since here the function of the sinkers can be performed by the needles themselves. The sinkers are also displaced toward its cylinder during the transfer of loops back on to the needles, as seen in FIG 9.

Figures 14A, 14B, 15A, 15B:
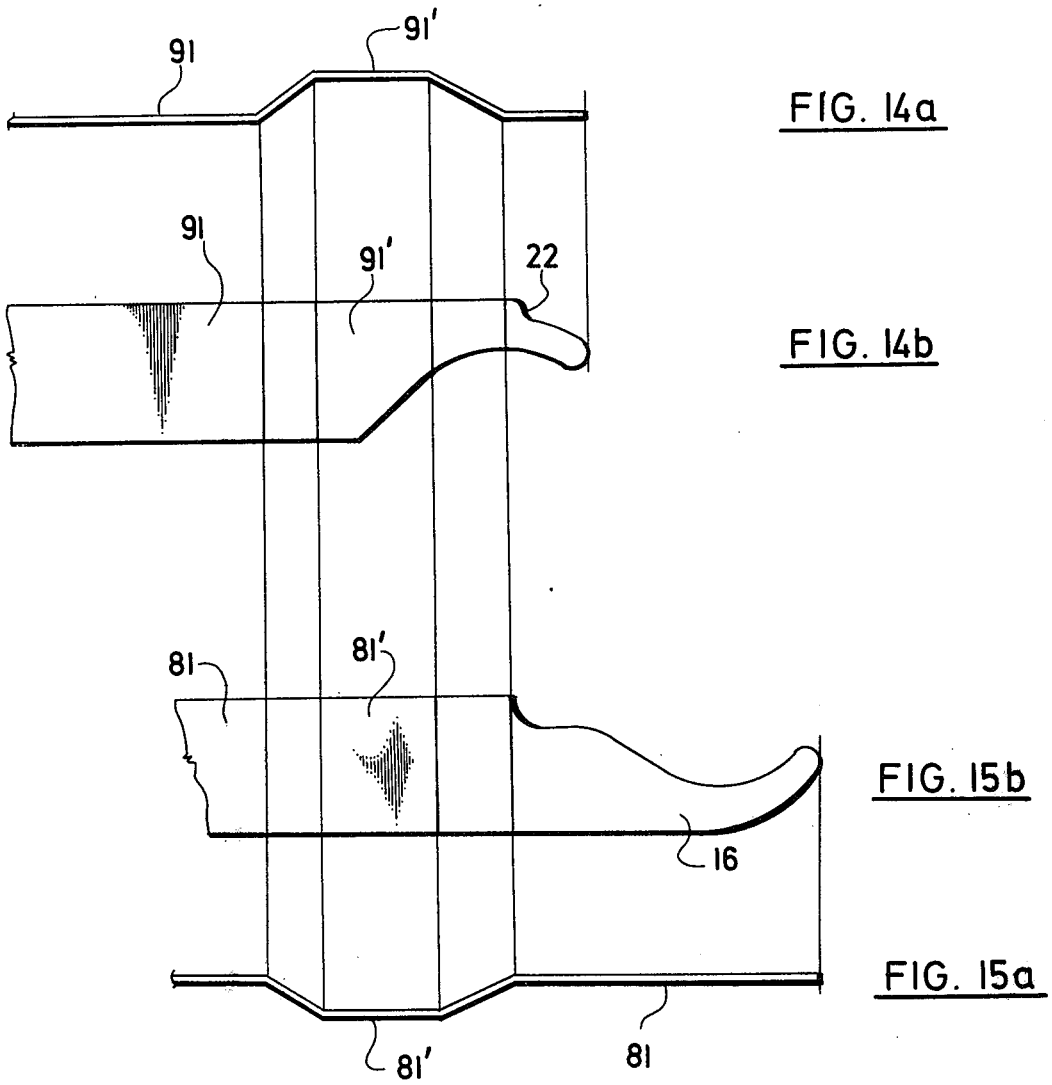
FIG. 14*a* and FIG. 14*b*, respectively, are plan and side views of a further embodiment of the second or transfer element.
FIG. 15*a* and FIG. 15*b* are respectively side and plan views of a further embodiment of the first or gripping element.

The method of knitting and transferring the loops to the needles of the cylinder, as described above, may be performed also by means of the use of only two knitting members rather than the assembly of three described above. Modification of the transfer element 9 is shown in FIGS. 14*a* and 14*b*, while modification of the gripping elements 8 is shown in FIGS. 15*a* and 15*b*. In FIGS. 15*a* and 15*b* the gripping member 81, is the same as that shown in FIG. 2 and is indeed in identical structure to it. The transfer member 91, is, however, bent to provide a shoulder 91' immediately behind the vertical edge 22. The members 81 and 91 are shown in mutual position by means of the vertical lines, the shoulders 8' and 91' being arranged abreast of each other. In this position, the tips of each of the members 81 and 91 are offset from each other. Putting it another way, when the tips of each of the members are abreast of each other, the shoulders 81' and 91' are themselves offset. With the use of these two members the duplicate use of a gripping member 10, shown heretofore, may be dispensed with. The yarn being knitted into a loop and gripped on the member 81 solely and being transferred by the member 91 in the manner previously described.

It will be apparent from the foregoing that various modifications and changes may be made without departing from the concept of the present invention. Accordingly, the accompanying drawings and foregoing description are to be taken as illustrative only of the present invention and not as limiting of its scope.

What is claimed is:

1. In a knitting machine having a vertically grooved cylinder and a horizontally grooved dial, a plurality of needles each reciprocatingly mounted in the grooves of said cylinder, and a plurality of knitting elements each reciprocatingly mounted in the grooves of said dial to cooperate with associated ones of said needles to form knit work loops and to transfer said loops to said needles, said knitting elements comprising a pair of blade-like members arranged along one longitudinal edge in each of the respective grooves of said dial and being movable within said groove with respect to each other, one of said members having an operative end comprising an upwardly directed finger having a forward tip and spaced along the upper edge thereof with indentations thereon forming a front yarn receiving bed and a rear yarn receiving bed which serve to positively support the loops during the transfer operation, the second of said members having an operative end comprising a downwardly directed finger having a forward tip above the level of the surface of the front bed of said one member said second member having an upper edge rising from the tip thereof to the level above the rear bed of said one member and an indentation thereon forming a yarn receiving bed thereat and a lower edge forming with the front bed of said one member a space therebetween for gripping a yarn loop when the forward tips of each member are abreast of each other.

2. The knitting elements according to claim 1 wherein the upper edge of said second member includes a substantially vertical portion extending from a level about the tip thereof to a level above the surface of the rear bed of said one member.

3. The knitting elements according to claim 1 wherein one of said members is bent between its ends to form a shoulder for the passage of a needle.

4. The knitting elements according to claim 1 wherein the rear bed is at a level above the front bed and the upper edge of said one member connecting said beds is inclined therebetween.

5. The knitting elements according to claim 1 including a third blade-like member, comprising a mirror image of said one member, said other member being arranged between said one and said third members, at least one of said one and third members being bent to provide a shoulder for the passage of said associated needles.

6. The knitting elements according to claim 1 wherein the tip of said second member is at a level below the surface of said rear bed of said one member.

7. The knitting elements according to claim 1 wherein each of said members is independent of the other and is provided with means for reciprocating the same independently in each of their associated grooves.

* * * * *